United States Patent [19]

Suzuki et al.

[11] Patent Number: 4,922,585

[45] Date of Patent: May 8, 1990

[54] LIGHT-REFLECTIVE SLIDE FASTENER

[75] Inventors: Takashi Suzuki; Isamu Kumano, both of Kurobe, Japan

[73] Assignee: Yoshida Kogyo K. K., Tokyo, Japan

[21] Appl. No.: 220,715

[22] Filed: Jul. 11, 1988

[30] Foreign Application Priority Data

Jul. 14, 1987 [JP] Japan ..... 62-176898

[51] Int. Cl.[5] ..... A44B 19/34; G09F 13/16

[52] U.S. Cl. ..... 24/381; 24/389; 350/105

[58] Field of Search ..... 24/381, 395, 401, 410, 24/405, 435, 90 A, 90 HA; 40/582; 350/103, 105

[56] References Cited

U.S. PATENT DOCUMENTS

| | | | |
|---|---|---|---|
| 2,236,033 | 3/1941 | Killmer . | |
| 2,495,033 | 1/1950 | Sullivan . | |
| 3,154,872 | 11/1964 | Nordgren | 350/105 |
| 3,255,504 | 6/1966 | Porepp . | |
| 3,413,058 | 11/1968 | Chi Fang Tung et al. | 350/105 |
| 3,580,793 | 5/1971 | Hewitt | 24/90 HA |
| 3,919,744 | 11/1975 | Kandou | 24/395 |
| 3,925,858 | 12/1975 | Thaeler | 24/381 |
| 3,936,567 | 2/1976 | Vesely | 350/105 |
| 3,994,086 | 11/1976 | Mizuochi | 40/582 |
| 4,075,049 | 2/1978 | Wood | 350/105 |
| 4,268,117 | 5/1981 | Sevelin | 350/105 |
| 4,496,618 | 1/1985 | Pernicano | 350/105 |
| 4,630,891 | 12/1986 | Li | 350/105 |

FOREIGN PATENT DOCUMENTS

| | | | |
|---|---|---|---|
| 2805120 | 8/1978 | Fed. Rep. of Germany | 24/381 |
| 2335124 | 7/1977 | France . | |
| 0133396 | 11/1978 | Japan | 40/582 |
| 58-91912 | 6/1983 | Japan . | |
| 899967 | 6/1962 | United Kingdom . | |
| 2125886 | 3/1984 | United Kingdom | 24/389 |

*Primary Examiner*—Victor N. Sakran

*Attorney, Agent, or Firm*—Hill, Van Santen, Steadman & Simpson

[57] ABSTRACT

A light-reflective or luminous slide fastener is disclosed which is provided with a light-reflective strip including a multiplicity of glass beads and bonded to a row of coupling elements on each of a pair of fastener tapes. The strip extends longitudinally at least partially over the upper surfaces of the row of elements, or extends more extensively over the element surfaces so as to mask substantially the entire elements from view when the fastener is closed.

10 Claims, 6 Drawing Sheets

LIGHT-REFLECTIVE SLIDE FASTENER

BACKGROUND OF THE INVENTION

1. Field of the Invention

This invention relates to slide fasteners and more particularly to such a slide fastener which has a luminous or light-reflective function.

2. Prior Art

Slide fasteners of the type mentioned are known for example as disclosed in Japanese Laid-Open Patent Publcation No. 58-91912 in which there is shown a slide fastener having a luminous strip carrying thereon a fluorescent coating or a multiplicity of fine glass beads, the strip being secured to the web of the fastener tape by sewing or with an adhesive compound.

When applying such a slide fastener onto a garment article, this is usually done by sewing the fastener tape closely along its fastener elements to the edges of an opening in the garment fabric, in which instance the luminous strip on the fastener is apt to be masked from view. Alternatively, the fastener may be sewn in place with its element-carrying portion spaced sufficiently apart from the opening of the garment fabric. This would however involve the use of a relatively wide fastener tape, necessarily wider than the standard specification.

The prior art luminous slide fastener has a further drawback in that the sewing needle undergoes wear over short periods of time when it is used in contact with glass beads on the luminous strip.

SUMMARY OF THE INVENTION

It is the primary object of the present invention to provide a slide fastener having a light-reflective function which will overcome the foregoing drawbacks of the prior art.

A more specific object of the invention is to provide a slide fastener with a light-reflective of luminuous zone extending over and along a row of fastener coupling elements on each of a pair of support tapes.

According to the invention, there is provided a light-reflective slide fastener which comprises a pair of support tapes each carrying on their respective longitudinal inner edges a row of coupling elements in the form of discrete or continuous intermeshing teeth, each of said elements having a coupling head portion, a leg portion and a heel portion; a slider adapted to bring said elements on the respective tapes into and out of engagement; and a flexible light-reflective strip extending longitudinally at least partially over and secured to the upper surfaces of said row of coupling elements.

The above and other objects of the invention will be better understood from the following detailed description taken in conjunction with the accompanying drawings in which like reference numerals refer to like and corresponding parts throughout the several views.

DETAILED DESCRIPTION

Figure 1:
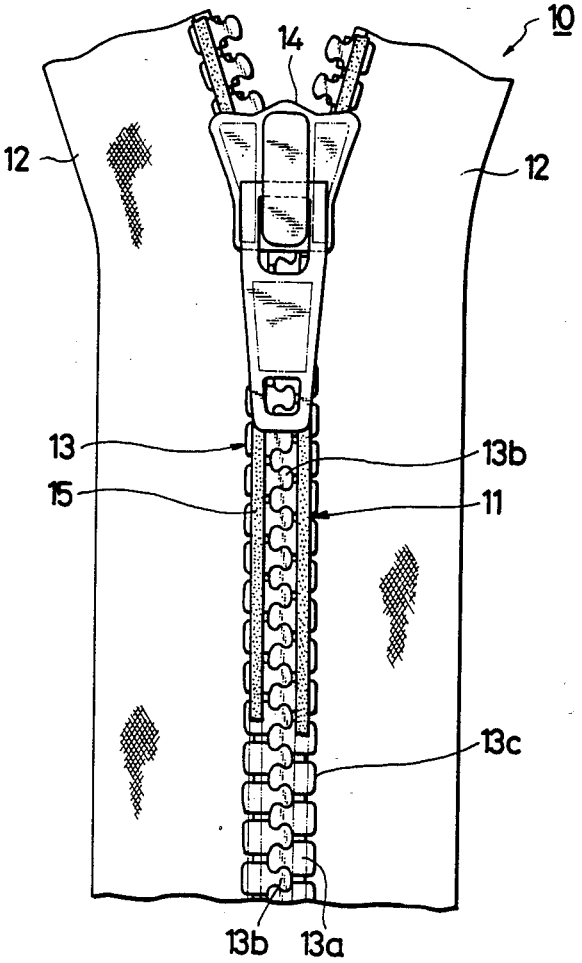
FIG. 1 is a plan view of a light-reflective slide fastener embodying the invention.

Referring now to the drawings and FIG. 1 in particular, there is shown a slide fastener 10 embodying the invention which comprises a pair of stringers 11 each including a support tape 12 and a row of coupling elements 13 secured to a longitudinal inner edge of the tape 12. The coupling elements 13 are formed from for example injection-molding a plastics material to and along the tape edges in a discrete formation. The rows of coupling elements 13 on oppositely disposed support tapes 12 are brought into and out of engagement with each other by manipulating a slider 14 in a manner well known to open and close the fastener 10.

The coupling elements 13 may be formed by extrusion of a plastics material or by metal die-casting.

A light-reflective or luminous strip 15 is in the form of an elongate narrow flexible fabric tape which is capable of demonstrating the existance of a slide fastener mounted article by reflecting a light in a dark environment primarily for safety purposes.

According to a preferred embodiment shown in FIG. 1, the strip 15 extends longitudinally partially over and masks the upper surfaces of leg portions 13*a* of the coupling elements 13 with coupling head portions 13*b* and heel portions 13*c* exposed to view when the opposed stringers 11, 11 are coupled together.

Figure 2:
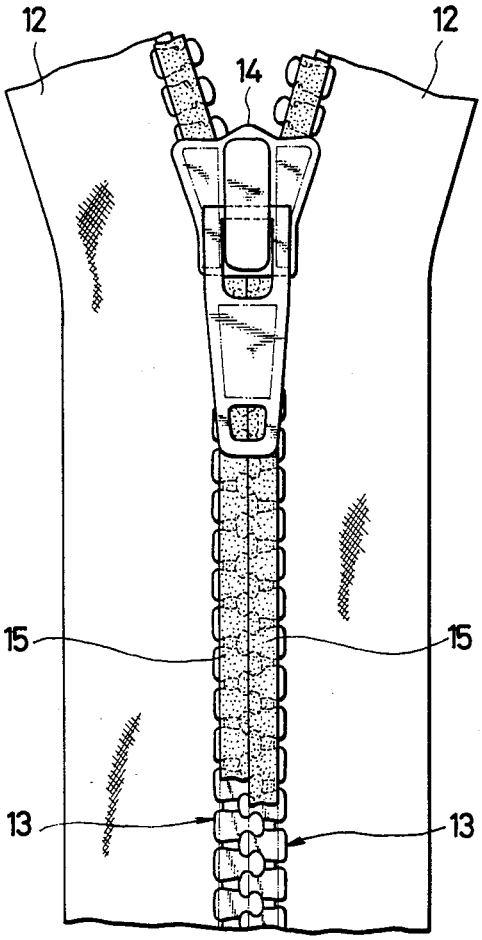
FIG. 2 is a view similar of FIG. 1 showing a modified form of the invention.

FIG. 2 shows another preferred embodiment in which the light-reflective strip 15 extends over and masks substantially the entire surface portions of the rows of coupling elements 13 as viewed in the closed disposition of the fastener 10, except for the heel portions 13*c* which are left intact for sliding contact with the slider 14.

Figure 7:
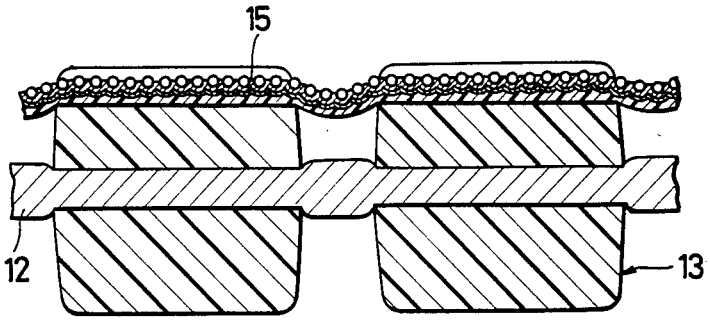
FIG. 7 is a longitudinal cross-sectional view on magnified scale of two adjacent coupling elements carrying a light-reflective strip.

As is known, the fastener stringers 11, 11 yield themselves in conformity with the Y-shaped guide channel of the slider 15 when the fastener 10 is opened or closed and can do so without damage to or separation of the light-reflective strip 15 from the coupling element row 13 as the material of the strip 15 is highly flexible. To help in such yielding behavior of the strip 15, the latter may be somewhat sagged in between adjacent coupling elements 13 as better shown in FIG. 7. This arrangement ensures prolonged service life of the strip 15.

Figure 8:
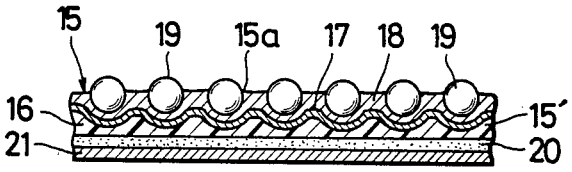
FIGS. 8 and 9 each are a cross-sectional view on magnified scale of a light-reflective zone in a slide fastener according to the invention.
Figure 9:
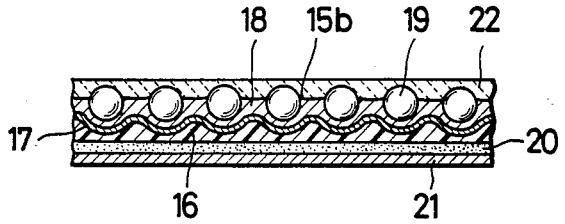

The detailed construction of the light-reflective zone 15' is better shown in FIG. 8 which represents an open-type light-reflective strip 15*a* and also in FIG. 9 which represents a closed-type light-reflective strip 15*b*.

The open-type strip 15*a* comprises a base layer 16 of a saturated polyester resin, a reflective layer 17 of an aluminum, copper, silver or other suitable metals bonded to the upper surface of the base layer 16 by fusion, plating or coating, an adhesive layer 18 of a polyvinylbutyral laid over the reflective layer 17 and a multiplicity of glass beads 19 embedded halfway in the adhesive layer 18. The reflective layer 17 extends in a wavy configuration, as cross-sectionally observed, providing alternate ridges 17*a* and grooves 17*b* so that the lower half of each individual glass beads 19 is received and bonded in such groove 17*b* by the adhesive layer 18. The upper half of the bead 19 is exposed to view as it protrudes above the surface of the adhesive layer 18. The beads 19 are thus held in place without being superimposed one over another. An adhesive layer 20 preferably of a heat-sensitive type is attached to the lower surface of the base layer 16 and may if necessary be deposited with a releasing paper 21.

The closed type light-reflective strip 15*b* shown in FIG. 9 is substantially the same in construction as the open-type 15*a*, except that there is provided a transparent cover layer 22 made of acryl or other suitable resins bonded to the adhesive layer 18 and adapted to envelop the exposed upper half portions of the glass beads 19.

Figure 3:
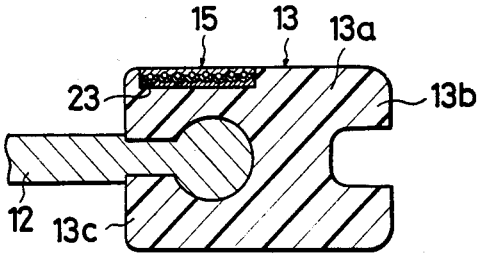
FIG. 3 is a transverse cross-sectional view on enlarged scale of coupling element having a light-reflective strip embedded therein.

The manner in which the light-reflective strip 15 is bonded to the coupling element row 13 is shown in FIG. 3 wherein the strip is embedded in a recess 23 and bonded in place by the application of heat and pressure as by ironing, in which instance the releasing paper 21 is of course removed.

Figure 4:
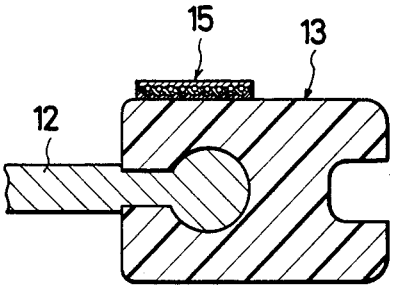
FIG. 4 is a view similar to FIG. 3 but showing a light-reflective strip mounted on the upper surface of the coupling element.
Figure 5:
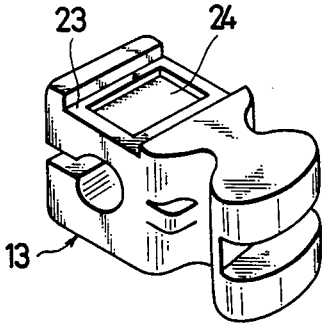
FIG. 5 is a perspective view of a coupling element having a groove formed in its upper surface for receiving a light-reflective strip.
Figure 6:
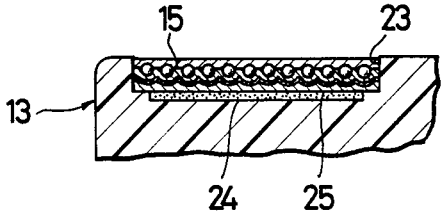
FIG. 6 is a cross-sectional view of a portion of the coupling element in FIG. 5 in which a light-reflective strip is embedded.

FIG. 4 shows adhesively applying the strip 15 directly to the upper leg portions 13*a* of the coupling elements 13. In either case, it has been found desirable to provide a reservoir 24, as shown in FIGS. 5 and 6, in each of the coupling elements 13 for retaining an adhesive compound 25 (FIG. 6) whereby the strip 15 can be more effectively bonded to the element row 13. While the strip 15 can be bonded with an adhesive received in the recess 23, there is fear that the adhesive may drip out resulting in less adhesive strength and smeared tape.

The light-reflective strip 15 is thin enough to avoid abrasive contract with the slider 14, for which purpose its thickness should not literally exceed a clearance gap between the slider interior wall and the upper surface of the coupling elements 13.

Figure 10:
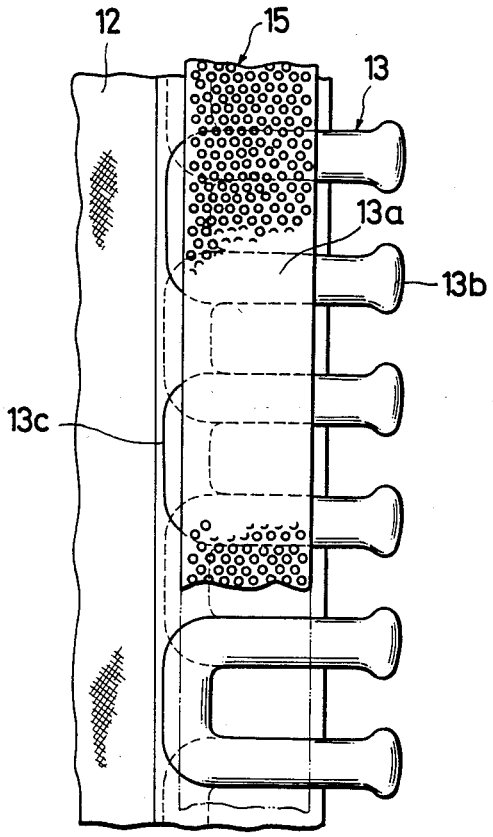
FIG. 10 is a plan view on enlarged scale of a portion of a slide fastener stringer carrying meandering coupling elements.
Figure 11:
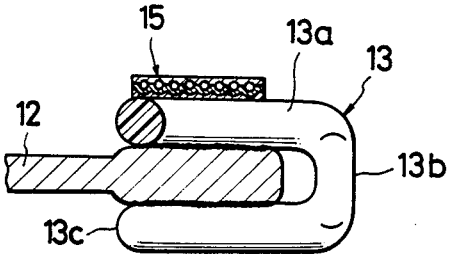
FIGS. 11 and 12 each are a transverse cross-sectional view of FIG. 10.

FIG. 10 shows applying the light-reflective strip 15 with an adhesive, by fusion or sewing to a meandering type of slide fastener element row which is bonded by fusion to the support tape 12 in a manner shown in FIG. 11.

Figure 12:
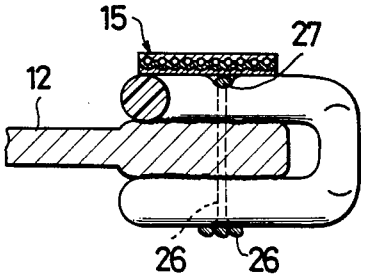

FIG. 12 is a vie similar to FIG. 11 but it shows sewn stitches 26 securing the elements 13 to the tape 12 and embedded in grooves 27 in the upper surfaces of the elements 13 over which strip 15 is effectively bonded in place.

Figure 13:
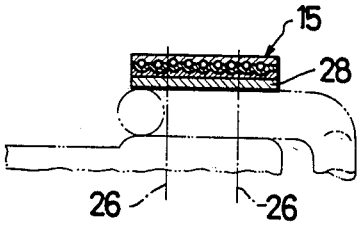
FIGS. 13 and 14 are cross-sectional view of two different forms in which the light-reflective strip is applied to the slide fastener.

FIG. 13 shows applying the strip 15 to the elements 13 by sewing the same through a woven, non-woven or knitted fabric braid 28.

Figure 14:
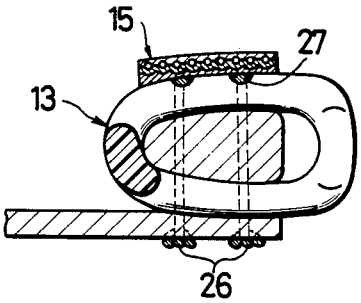

FIG. 14 shows applying the strip 15 by sewn stitches 26 to a continuous helical coil element structure.

Obviously, various modifications and variations of the present invention are possible in the light of the above teaching. It is therefore to be understood that within the scope of the appended claims the invention may be practiced otherwise than as specifically described.

What is claimed is:

1. A light-reflective slide fastener which comprises:

a pair of support tapes each carrying on their respective longitudinal inner edges a row of coupling elements in the form of intermeshing teeth, each of said elements having a coupling head portion, a leg portion and a heel portion, said coupling elements having recesses which form a continuous recess along said row of coupling elements;

a slide adapted to bring said elements on the respective tapes into and out of engagement; and a continuous flexible light-reflective strip extending longitudinally at least partially over and secured in said continuous recess of said row of coupling elements and disposed independently from any portion of each of said tapes.

2. A light-reflective slide fastener as defined in claim 1 wherein said strip is secured to said row of elements by means of fusion.

3. A light-reflective slide fastener as defined in claim 1, wherein said strip comprises a base layer, a reflective layer bonded thereto by applying a metal, an adhesive layer laid over said reflective layer and a multiplicity of glass beads embedded substantially halfway in said adhesive layer.

4. A light-reflective slide fastener as defined in claim 3 wherein said strip further comprises a transparent cover layer extending over and enveloping said glass beads.

5. A light-reflective slide fastener as defined in claim 3 wherein said reflective layer extends in a wavy configuration as cross-sectionally viewed.

6. A light-reflective slide fastener as defined in claim 1, wherein ones of said elements are provided with reservoirs in said recesses adpated for receiving therein an adhesive compound.

7. A light-reflective slide fastener as defined in claim 1, wherein said strip is secured to said row of elements by means of adhesion.

8. A light-reflective slide fastener as defined in claim 1, wherein said strip is secured to said row of elements by means of sewing.

9. A light-reflective slide fastener which comprises:

a pair of support tapes each carrying on their respective longitudinal inner edges a row of coupling elements in the form of intermeshing teeth, each of said elements having a coupling head portion, a leg portion and a heel portion;

a slide adapted to bring said elements on the respective tapes into and out of coupling engagement; and a flexible light-reflective strip extending longitudinally at least partially over and secured to upper surfaces of said row of coupling elements and disposed independently from any portion of each of said tapes, said light-reflective strip being disposed in sagged relation with concave portions in gaps in between adjacent ones of said coupling elements to prevent tearing of said strip during coupling and uncoupling of said coupling elements.

10. A light-reflective slide fastener as defined in claim 6 wherein said light-reflective strip extends longitudinally more extensively over and secured to the upper surfaces of said row of elements so as to mask substantially the entirety of said elements from view when the fastener is closed.

* * * * *